US009541361B2

(12) United States Patent
Bae et al.

(10) Patent No.: US 9,541,361 B2
(45) Date of Patent: Jan. 10, 2017

(54) SHELL

(71) Applicant: AGENCY FOR DEFENSE DEVELOPMENT, Daejeon (KR)

(72) Inventors: Ju Hyun Bae, Gyeongsangbuk-do (KR); Wan Joo Kim, Daejeon (KR)

(73) Assignee: AGENCY FOR DEFENSE DEVELOPMENT (KR)

( * ) Notice: Subject to any disclaimer, the term of this patent is extended or adjusted under 35 U.S.C. 154(b) by 37 days.

(21) Appl. No.: 14/728,093

(22) Filed: Jun. 2, 2015

(65) Prior Publication Data

US 2016/0187112 A1 Jun. 30, 2016

(30) Foreign Application Priority Data

Dec. 31, 2014 (KR) ..... 10-2014-0196015

(51) Int. Cl.
*F42B 10/64* (2006.01)
*F42B 10/02* (2006.01)

(52) U.S. Cl.
CPC ..... *F42B 10/64* (2013.01); *F42B 10/02* (2013.01)

(58) Field of Classification Search
CPC ..... F42B 10/64; F42B 10/02
USPC ..... 244/3.24, 3.27, 3.28, 3.29
See application file for complete search history.

(56) References Cited

U.S. PATENT DOCUMENTS 2,421,752 A * 6/1947 Jones ..... F42B 12/68 102/222
2,961,196 A * 11/1960 Atkinson ..... B64C 3/40 244/46
4,607,810 A * 8/1986 Frazer ..... F42B 10/16 206/497
4,817,891 A * 4/1989 Gaywood ..... F42B 10/16 244/3.23
5,040,746 A * 8/1991 Mikhail ..... F42B 10/14 244/3.27

(Continued)

FOREIGN PATENT DOCUMENTS

JP 6-094397 4/1994
JP 10-185500 7/1998

(Continued)

OTHER PUBLICATIONS

Office Action mailed Feb. 13, 2015 in corresponding Korean Patent Application No. 10-2014-0196015.

(Continued)

*Primary Examiner* — Justin Benedik
(74) *Attorney, Agent, or Firm* — Ostrolenk Faber LLP

(57) ABSTRACT

Provided is a shell including: a shell body; a steering wing including a drive shaft and that mounted on an external surface of the shell body; an auxiliary wing including a shaft connection portion which is connected to the drive shaft and moving in the lengthwise direction of the drive shaft within the drive shaft to be inserted into and be spread outward from within the steering wing; an auxiliary-wing holding unit including a holding protrusion which is fixedly arranged in a direction of intersecting the shaft connection portion to selectively hold the auxiliary wing in place; and an auxiliary-wing spreading unit installed within the drive shaft, and that provides driving force for spreading the auxiliary wing outward from within the steering wing when the holding protrusion is disengaged with the shaft connection portion.

12 Claims, 8 Drawing Sheets

(56) References Cited

U.S. PATENT DOCUMENTS

| | | | | |
|---|---|---|---|---|
| 5,189,250 | A * | 2/1993 | Shaphyr | F42B 10/16 102/247 |
| 7,004,425 | B2 * | 2/2006 | Okada | F42B 10/20 244/3.29 |
| 8,367,993 | B2 * | 2/2013 | Velez | F42B 10/48 244/3.27 |
| 2004/0217227 | A1 * | 11/2004 | Alculumbre | F42B 10/16 244/3.28 |
| 2012/0048993 | A1 * | 3/2012 | Velez | F42B 10/48 244/3.28 |
| 2012/0091256 | A1 * | 4/2012 | Alculumbre | F42B 10/16 244/3.29 |

FOREIGN PATENT DOCUMENTS

| | | |
|---|---|---|
| JP | 2001-141395 | 5/2001 |
| JP | 2014-156973 | 8/2014 |

OTHER PUBLICATIONS

Notice of Allowance mailed Apr. 23, 2015 in corresponding Korean Patent Application No. 10-2014-0196015.

* cited by examiner

SHELL

CROSS-REFERENCE TO RELATED APPLICATION

Pursuant to 35 U.S.C. §119(a), this application claims the benefit of earlier filing date and right of priority to Korean Application No. 10-2014-0196015, filed on Dec. 31, 2014, the contents of which are incorporated by reference herein in its entirety.

BACKGROUND OF THE DISCLOSURE

1. Field of the Disclosure

The present disclosure relates to a shell and more particularly to a steering wing that is mounted in a shell in order to steer the shell in a guided manner.

2. Background of the Disclosure

In order to hit a target, a shell is launched with explosion pressure of power gas due to an explosion of a propellant loaded into a barrel of a cannon.

The shell has a fuse in the front thereof so that, when an impact is applied to the shell, or when an explosion condition is met (for example, when the shell approaches the target), the shell can be exploded. Internal explosion due to ignition of the fuse occurs after the shell is launched from the cannon. Thus, the target is destroyed.

In recent years, extended-range guided munitions have been under development. The extended-range guided munitions are designed to extend a range using a small-sized rocket motor that is mounted in the shell in addition to the explosion pressure of the propellant and to hit the target with more precision using a Global Positioning System (GPS).

As one of the extended-range guided munitions, the shell has a steering wing mounted on itself and is equipped with a Global Positioning System (GPS) and an Inertial Navigation System (INS). Thus, it is possible to change a point of impact while the shell is in flight after being launched.

There is a method of enlarging the steering wing to increase steering performance of the steering wing. However, due to a limitation on an internal diameter of the shell, this method has a limitation in manufacturing a large-sized wing. Particularly, the method has a disadvantage in that the larger the steering wing, the greater the aerodynamic drag that acts on the shell.

As the case may be, there is a method in which the steering wing stays within the shell and at a specific point in time, is spread. However, when this method is employed, a separate internal space in which interference with a driving is unit that steers a wing does not occur and a wing spreading unit are further necessary.

SUMMARY OF THE DISCLOSURE

Therefore, an aspect of the detailed description is to provide a shell in which an area of a steering wing is selectively increased and thus steering performance is improved without aerodynamic drag being increased while the shell is in flight.

To achieve these and other advantages and in accordance with the purpose of this specification, as embodied and broadly described herein, there is provided a shell including: a shell body; a steering wing that includes a drive shaft and that is rotatably mounted on an external surface of the shell body; an auxiliary wing that includes a shaft connection portion which is connected to the drive shaft in such a manner that the auxiliary wing is able to move in the lengthwise direction of the drive shaft within the drive shaft, and that is installed in such a manner that the auxiliary wing is able to be inserted into and be spread outward from within the steering wing; an auxiliary-wing holding unit that includes a holding protrusion which is fixedly arranged in a direction of intersecting the shaft connection portion in such a manner that the holding protrusion is engaged with or disengaged with the shaft connection portion depending on an angle at which the drive shaft rotates, and that selectively holds the auxiliary wing in place; and an auxiliary-wing spreading unit that is installed within the drive shaft, and that provides driving force for spreading the auxiliary wing outward from within the steering wing when the holding protrusion is disengaged with the shaft connection portion.

In the shell, a locking groove may be formed in a lateral surface of the shaft connection portion in such a manner that the holding protrusion is able to inserted into the locking groove, and the holding protrusion may be engaged with the locking groove, thereby holding the auxiliary wing in place within the steering wing after the auxiliary wing is inserted into the steering wing.

In the shell, a guide groove may be concavely formed in an internal surface of the drive shaft along the lengthwise direction of the drive shaft, and In the shell, a guide protrusion may be formed on a lower end portion of the shaft connection portion in such a manner that the guide protrusion protrudes toward an internal surface of the drive shaft and moves along the guide groove.

In the shell, the drive shaft may include a stopper that is formed on one end portion of the guide groove and may prevent the guide protrusion from being separated from the guide groove.

In the shell, a permanent magnet may be built into each of the guide protrusion and the stopper, and when the guide protrusion is positioned adjacent to the stopper, the guide protrusion may be held in place with respect to each other.

In the shell, while the shell body is in trajectory flight, the auxiliary may be inserted into the steering wing, and at a point in time where the shell body flies from a trajectory flight section to a guided flight section, the auxiliary wing may be spread outward from within the steering wing by the auxiliary-wing spreading unit.

In the shell, the auxiliary-wing spreading unit may be installed between the shaft connection portion of the auxiliary wing and the drive shaft, and the auxiliary may be a compression spring that elastically supports the auxiliary wing.

In the shell, at least two or more holding protrusions may be formed within the auxiliary-wing holding unit in such a manner that the two or more holding protrusion are positioned a distance away from one another.

In the shell, the steering wing includes a driving-unit connection shaft may be connected to one end portion of the drive shaft in such a manner that the auxiliary wing pierces through the one end portion of the drive shaft in the direction of the diameter, and with driving force that is transferred from a driving unit installed within the shell body, the steering wing may rotate.

In the shell, a protrusion insertion hole may be formed in an external surface of the drive shaft along circumference of the drive shaft in such a manner that the holding protrusion passes through the protrusion insertion hole for insertion.

In the shell, the holding protrusion and the guide protrusion may be arranged in such a manner that the holding protrusion and the guide protrusion intersect each other.

In the shell, the auxiliary-unit holding unit may include a holding portion that supports the holding protrusion and that is fixedly installed within the shell body in such a manner that the holding portion is positioned a distance away from an external surface of the drive shaft, and the holding protrusion may be formed on an internal surface of the holding portion in such a manner that the holding protrusion extends inward toward the center of the holding portion from the internal surface of the holding portion.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Figure 1:
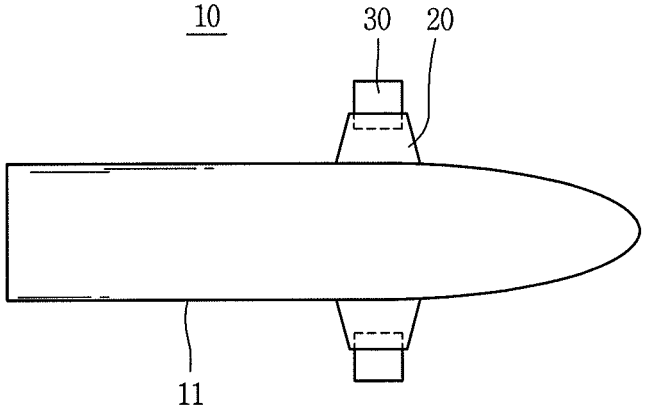
FIG. 1 is a diagram illustrating a shell in which an auxiliary wing according to one embodiment is spread.

Description will now be given in detail of the exemplary embodiments, with reference to the accompanying drawings. For the sake of brief description with reference to the drawings, the same or equivalent components will be provided with the same reference numbers, and description thereof will not be repeated.

Embodiments of the present invention will be described below referring to the drawings in such a manner that any person skilled in the art of the invention is enabled to make and use the invention without undue experimentation.

FIG. 1 is a diagram illustrating a shell 10 according to one embodiment of the present invention, of which an auxiliary wing 30 is spread.

The present invention relates to the shell 10 equipped with a steering wing 20 that achieves improved efficiency of steering and minimizes aerodynamic drag while the shell 10 is in flight.

The shell 10 includes a shell body 11 and the steering wing 20.

The shell body 11 is configured to be cylinder-shaped and has a fuse in the front thereof.

The steering wing 20 is rotatably provided to the shell body 11, and rotation of the steering wing 20 guides the shell body 11 along a given flight path.

The steering wing 20 includes a drive shaft 50 that is rotatably installed within the shell body 11, and is connected to an external surface of the shell body 11. The steering wing 20 rotates about the drive shaft 50.

As illustrated in FIG. 1, the auxiliary wing 30 is connected to the steering wing 20 in such a manner that the auxiliary wing 30 can extend from within the steering wing 20.

The auxiliary wing 30 is held in place within the steering wing 20 while the shell 10 is in flight in a trajectory flight section. The auxiliary wing 30 is spread outward from within the steering wheel 20 without being driven by a separate driving device while the shell is in a guided flight section. Thus, the auxiliary wing 30 performs an auxiliary function of increasing a steering area of the steering wing 20.

At this point, the trajectory flight section means a section in which the shell 10 has to fly along a flight path, such as a parabola, which is determined in advance before the shell 10 is launched.

The guided flight section means a section in which the shell 10 is guided toward a target. The flight path is changed from the trajectory flight section to the guided flight section when, after the shell 10 is launched, a trajectory for the shell 10 is required to be changed due to a flight environment and the like. This is done in order to hit the target.

While in flight to hit the target, it is necessary to minimize the aerodynamic drag that acts on the shell 10 in the trajectory flight section and to increase the steering area of the steering wing 20 in the guided flight section by spreading the auxiliary wing 30, in order to improve steering performance of the shell 10.

To do this, according to the present invention, the auxiliary wing 30 is provided that increases the steering area of the steering wing 30 without using a separate driving device in the guided flight section.

Figure 2:
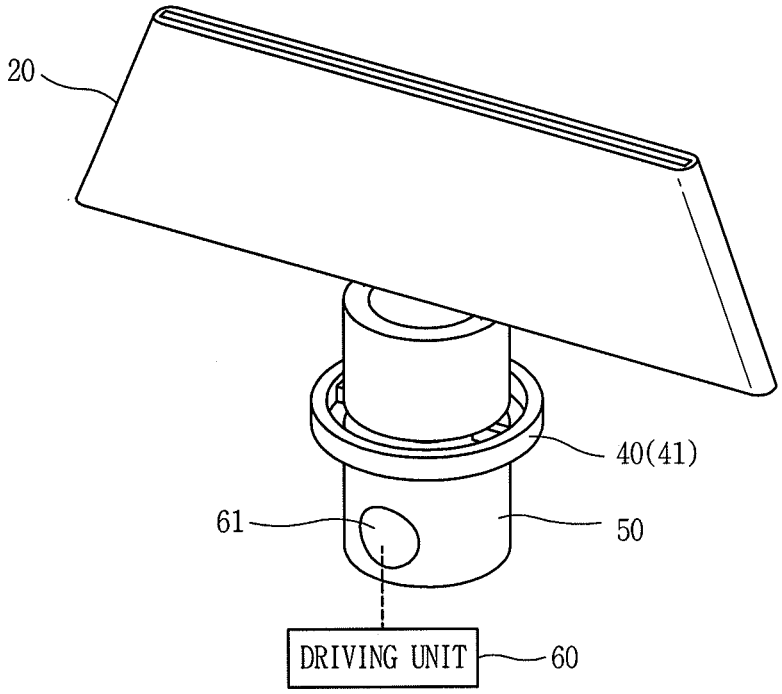
FIG. 2 is a perspective diagram illustrating that the auxiliary wing according to one embodiment of the present invention is inserted into a steering wing.
Figure 3:
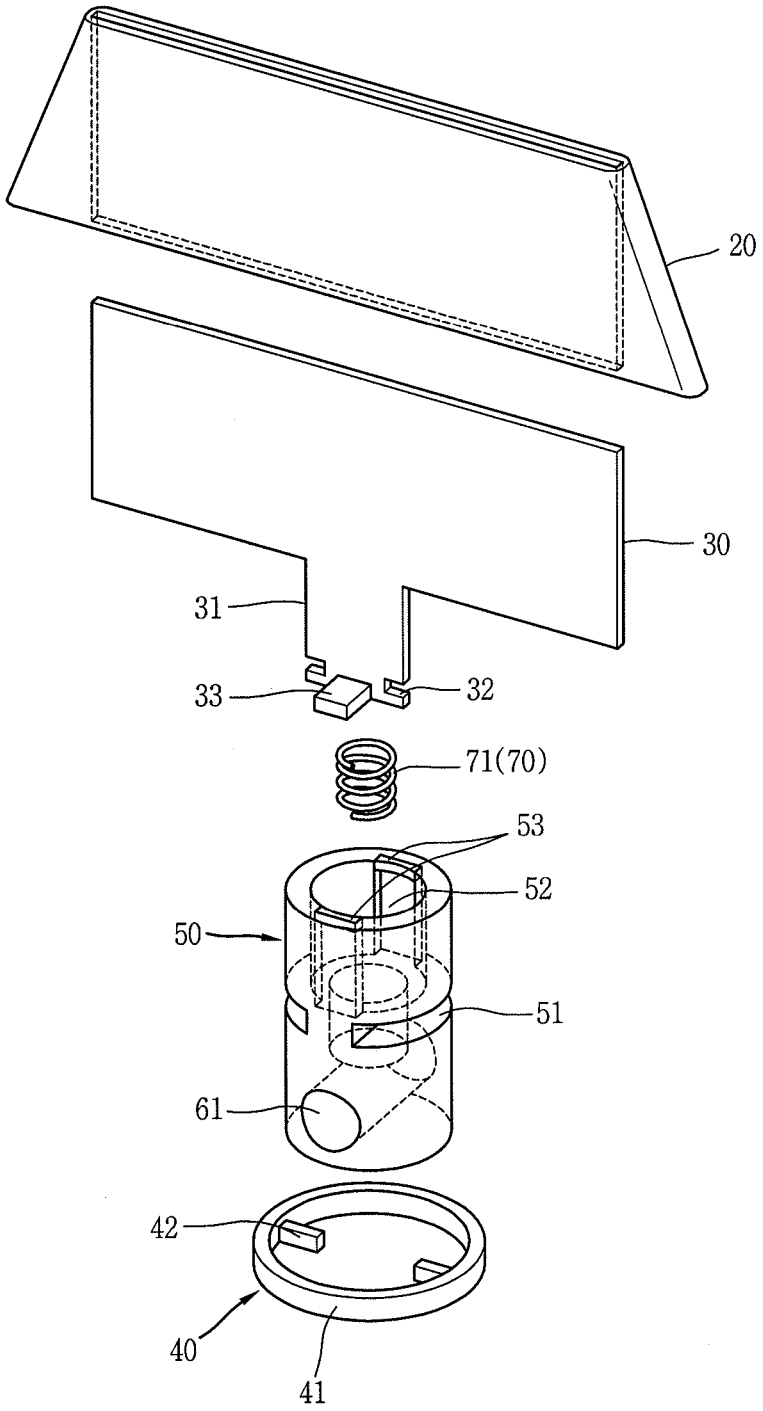
FIG. 3 is a perspective diagram illustrating the auxiliary wing that is mounted within the steering wing in FIG. 2.

FIG. 2 is a perspective diagram illustrating that the auxiliary wing 30 according to one embodiment of the present invention is inserted into the steering wing 20. FIG. 3 is a perspective diagram illustrating the auxiliary wing 30 that is mounted within the steering wing 20 in FIG. 2.

Referring to FIG. 2, the steering wing 20 of the shell 10 according to the present invention includes the auxiliary wing 30. The auxiliary wing 30 is installed in such a manner that the auxiliary wing 30 can be inserted into the steering wing 20.

In a case where the shell 10 is in flight in the trajectory flight section in a state where the auxiliary shell 30 is inserted into the steering wing 20, the aerodynamic drag that acts on the shell 10 is minimized.

The steering wing 20 has the drive shaft 50 on one side thereof and is rotatably supported on the external surface of the shell body 11.

The drive shaft 50 is installed within the shell body 11.

The steering wing 20 is configured to be ladder-shaped. However, the steering wing 20, of course, may be configured to have various shapes in order to increase a range and to improve steering performance.

In addition, the steering wing 20 is configured to have the shape of a flat tube in order to accommodate the steering wing 20 within the steering wing 20.

The drive shaft 50 is provided on one surface (which is illustrated as a lower surface in the drawings) of the steering wing 20. An opening is formed in the opposite surface (which is illustrated as an upper surface in the drawings) of the steering wing 20 in such a manner that through the opening, the auxiliary wing 30 is inserted into and is spread outward from within the steering wing 20.

The drive shaft 50 is configured to have the shape of a cylinder that has a through hole in the middle.

The drive shaft 50 includes a driving-unit connection shaft. The driving-unit connection shaft is connected to a lower end portion of the drive shaft 50 in a manner that pierces through the lower end portion in the direction of the diameter.

The driving-unit connection shaft 61 is connected to a driving unit 60 that is installed within the shell body 11 in order to transfer driving force to the drive shaft 50.

The driving unit 60 or the actuator includes a motor, a cylinder mechanism, and the like.

For example, the driving unit 60 may further include at least one or more driving-force transfer components that are selected from among a pulley, a belt (or a chain), and a gear (a bevel gear), in order to connect the motor and the driving-unit connection shaft 61 with each other for the transfer of driving force of the motor to the driving-unit connection 61.

In addition, the driving unit 60 may further include linking components in order to connect the cylinder mechanism and the driving-unit connection shaft 61 with each other for the transfer of driving force of the cylinder mechanism to the driving-unit connection shaft 61.

According to one embodiment of the present invention, an auxiliary-wing holding unit 40, an auxiliary-wing spreading unit 70, and the like. The auxiliary-wing holding unit 40 selectively holds the auxiliary wing 30 in place in such a manner that the auxiliary wing 30 can be inserted into and be spread outward from within the steering wing 20. The auxiliary-wing spreading unit 70 provides driving force for spreading the auxiliary wing 30 outward from within the steering wing 20 when releasing the auxiliary wing 30.

The auxiliary-wing holding unit 40 is configured to have the shape of a ring. The auxiliary-wing holding unit 40 is arranged on an external surface of the drive shaft 50 in such a manner that the auxiliary-wing holding unit 40 is positioned a distance away from an external surface of the drive shaft 50.

The auxiliary wing 30, the auxiliary-wing holding unit 40, the auxiliary-wing spreading unit 70, and constituent elements associated with these are described in detail referring to FIG. 3.

The auxiliary wing 30 is formed in such a manner that a length and a width of the auxiliary wing 30, as illustrated in the drawings, are somewhat smaller than those of the opening in order to be inserted through the opening formed in the upper surface of the steering wing 20.

In addition, the auxiliary wing 30 is formed in such a manner that a height of the auxiliary wing 30, as illustrated in the drawings, is somewhat smaller than, or equal to or approximately equal to that of the steering wing 20. This is done in order to insert the auxiliary wing 30 completely into the steering wing 20 and to increase the steering area of the steering wing 20 as much as possible.

The auxiliary wing 30 is provided to the steering wing 20 and rotates at the same rotation angle as does the steering wing 20.

The auxiliary wing 30 includes a shaft connotation portion 31. The shaft connection portion 31 is integrally formed on one portion of a bottom surface of the auxiliary wing 30 in such a manner that the shaft connection portion 31 protrudes from the one portion of the bottom surface.

The steering wing 20 is connected to the drive shaft 50 with the shaft connection portion 31 of the auxiliary wing 30 in between.

The shaft connection portion 31 extends from the one portion of the bottom surface of the auxiliary wing 30, and is inserted into the drive shaft 50 through a longitudinal hole formed in one portion of a bottom surface of the steering wing 20.

The auxiliary-wing holding unit 40 includes a holding portion 41 and at least two holding protrusions. The holding portion 41 is configured to be ring-shaped. The two holding protrusions extend inward toward the center from an internal surface of the holding portion 41.

In addition to being ring-shaped, the holding portion 41 may be configured to have various shapes.

At this point, the holding protrusions 42 are formed in such a manner that each of the holding protrusions 42 is positioned a distance away from the center of the holding portion 41.

The holding portion 41 is arranged outside of the drive shaft 50 and is installed within the shell body 11 in such a manner that the holding portion 41 is held in place by a separate holding member (not illustrated).

The holding protrusions 42 pierces through the drive shaft 50 in such a manner that the holding protrusions 42 are selectively engaged with the shaft connection portion 31 of the auxiliary wing 30 that is inserted into the drive shaft 50.

A protrusion insertion hole 51 is formed in an external surface of the drive shaft 50 along circumference of the drive shaft 50. The holding protrusions pass through the protrusion insertion hole 51 in the drive shaft 50. Interference with the holding protrusions 42 is avoided when the drive shaft 50 rotates.

The holding protrusions 42 and the shaft connection portion 31 are arranged within the drive shaft 50 in such a manner that the holding protrusions 42 and the shaft connection portion 31 intersect one another. The holding protrusions 42 extend inward toward the center of the drive shaft 50, and the shaft connection portion 31 extends in the lengthwise direction of the drive shaft 50.

In this case, locking grooves 32 are formed in lower portions of lateral surfaces of the shaft connection portion 31, respectively. The holding protrusions 42 are inserted into the locking grooves 32, respectively. Thus, the auxiliary wing 30 is held in place in a state where the auxiliary wing 30 is inserted into the steering wing 20.

In addition, the auxiliary-unit spreading unit 70 performs a function of spreading the auxiliary wing 30 outward without being driven by a separate driving device.

As the auxiliary-unit spreading unit 70, a compression spring 71 may be provided.

The compression spring 71 is installed within the drive shaft 50.

The compression spring 71 is arranged between the driving-unit connection shaft 61 and the shaft connection portion 31.

One end of the compression spring 71 is held in place within the drive shaft 50, and the other end is fixed to a lower end of the shaft connection portion 31. Thus, the auxiliary wing 30 is elastically supported by the compression spring in such a manner that the auxiliary wing 30 can be inserted into and be spread outward from within the steering wing 20.

For example, the auxiliary wing 30 is elastically supported by the compression spring 71 in a state where the auxiliary wing 30 is inserted into the steering wing 20 with the compression spring 71 being compressed. In such a state, when the auxiliary-wing holding unit 40 performs unlocking, that is, when the holding protrusions on the holding portion 41 is disengaged with the locking grooves 32, the auxiliary wing 30 is spread from within the steering wing 20 by elastic restoring force of the compression spring 71.

According to one embodiment of the present invention, a guide groove 52 is formed in an internal surface of the drive shaft 50 in order to guide a linear movement of the auxiliary wing 30.

The guide groove 52 is formed along the direction of the length of the drive shaft 50.

In addition, the auxiliary wing 30 includes a guide protrusion 33 that protrudes inward toward the center of the drive shaft 50 from a lower end portion of one surface of the shaft connection portion 31.

The guide protrusion 33 is engaged with the guide groove 52 in the drive shaft 50 in such a manner that the guide protrusion 33 can slide, and moves along the guide groove 52 in the lengthwise direction of the drive shaft 50. Thus, the auxiliary wing 30 is inserted and is spread.

At this point, a stopper 53 is formed on one end portion of the guide groove 52. The stopper 53 blocks a movement of the guide protrusion 33. Thus, the stopper 53 prevents the guide protrusion 33 from being separated from the drive shaft 50 when the auxiliary wing 30 is spread.

In addition, a permanent magnet (not illustrated) may be installed on at one portion of the guide protrusion 44, for example, one end portion of the guide protrusion 33, which is inserted into the guide groove 52.

In addition, a permanent magnet (not illustrated) may be installed on at least one portion of the stopper 53, for example, a lower portion of the stopper 53, which comes into contact with the guide protrusion 33.

The guide protrusion 33, when positioned adjacent to the stopper 53, is fixed to the stopper 53 by magnetic force of the permanent magnet.

With the engagement of the guide protrusion 33 with the guide groove 52, rotational force is transferred from the drive shaft 50 to the steering wing 20 and the auxiliary wing 30.

For example, rotation of the drive shaft 50 causes the guide groove 52 formed in the internal surface of the drive shaft 50 and the guide protrusion 33 engaged with the guide groove 52 to rotate together, which in return rotates the shaft connection portion 31 connected to the guide protrusion 33. Thus, the auxiliary wing 30 on which the shaft connection portion 33 is integrally formed and the steering wing 20 in which the auxiliary wing 30 is accommodated operate together.

At least one or more guide protrusions 33 may be formed.

For example, two guide protrusions 33 are one surface and the opposite surface of the shaft connection portion 31, respectively, or one guide protrusion 33 is connected to a connection groove formed in a lower end portion of the shaft connection portion 31 in a state where the one guide protrusion 33 pierces through the connection groove.

The guide protrusion 33 and the holding protrusion 42 are arranged in such a manner as to intersect each other.

For example, the guide protrusion 33 is formed on the shaft connection portion 31 in the shape of a plate in such a manner that the guide protrusion 33 is perpendicular to the shaft connection portion 31, and the holding protrusions 42 extend inward toward the center of the holding portion 41 from an internal surface of the holding portion 41 in order to be arranged on an imaginary line extending in the direction of the width of the shaft connection portion 31.

Accordingly, when the drive shaft 50 rotates in a range of 0 to approximately 90 degrees, the interference of the guide protrusion 33 and the holding protrusion 42 is avoided.

The operation mechanism of the auxiliary-wing holding unit 40 and the auxiliary-unit spreading unit that are provided to the drive shaft 50 will be described below.

FIGS. 4A to 4D are diagrams illustrating how the auxiliary wing 30 in FIG. 3 operates in order to be spread.

Figure 4A:
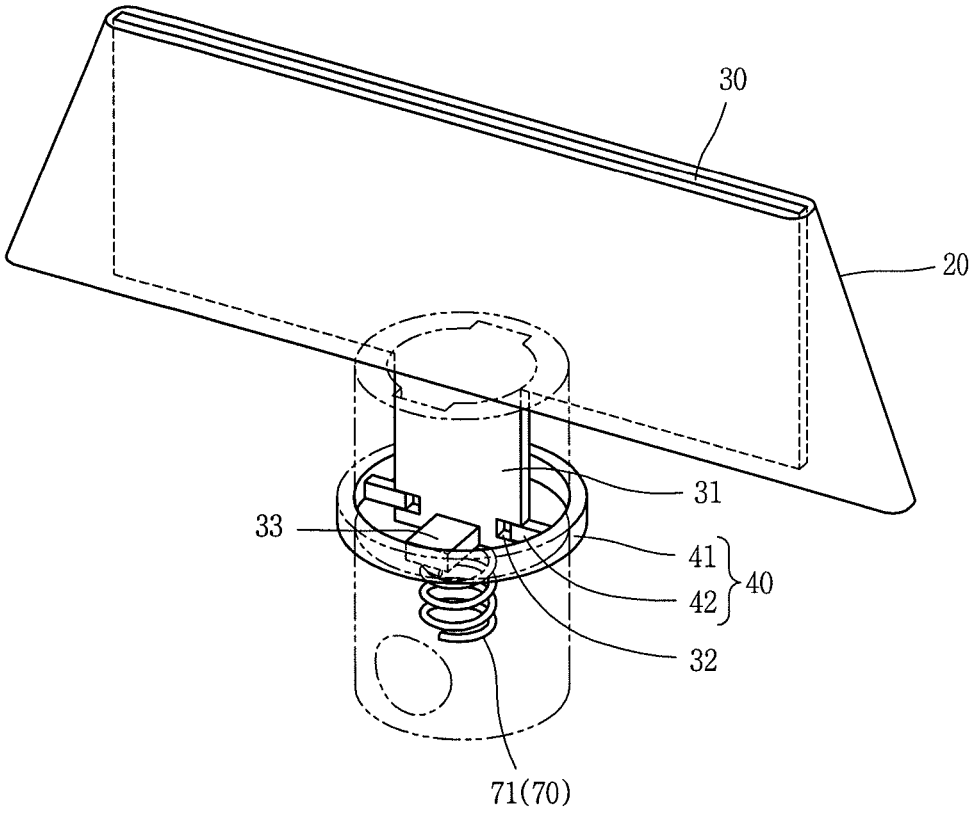
FIGS. 4A to 4D are diagrams illustrating how the auxiliary wing in FIG. 3 operates in order to be spread.

FIG. 4A illustrates that the auxiliary wing 30 is held in place by the auxiliary-wing holding unit 40 in a state where the auxiliary wing 30 is inserted into the steering wing 20.

As illustrated in FIG. 4A, the engagement of the holding protrusion 42 with the locking groove 32 formed in the shaft connection portion 31 of the auxiliary wing 30 makes the auxiliary wing 30 held in place within the steering wing 20 after the auxiliary wing 30 is inserted into the steering wing 20.

At this point, at a point in time where the shell 10 flies from the trajectory flight section to the guided flight section, driving force is transferred from the driving unit 60 to the steering wing 20.

In the guided flight section, the driving force generated in the driving unit 60 is transferred to the drive shaft 50 through the driving-unit connection shaft 61.

When the drive shaft 50 rotates, the shaft connection portion 31 rotates by the rotational force that is transferred through the guide groove 52 and the guide protrusion 33. Thus, the holding protrusion 42 is disengaged with the locking groove 32 formed in the lower end portion of the shaft connection portion 31, resulting in the unlocking.

Figure 4B:
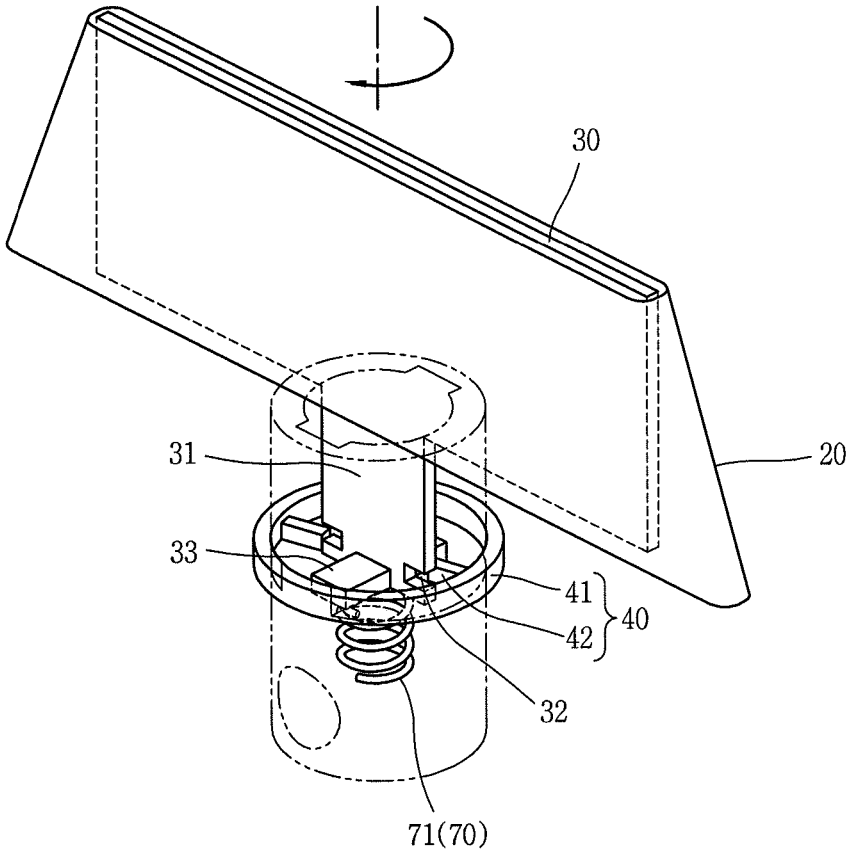
Figure 4C:
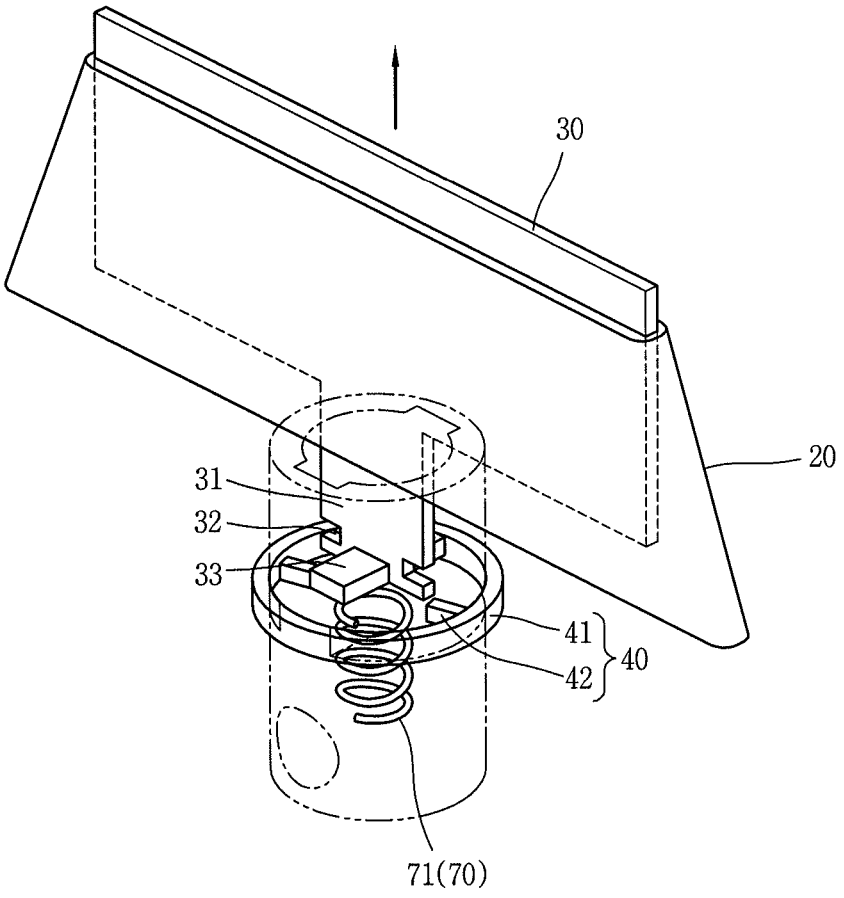
Figure 4D:
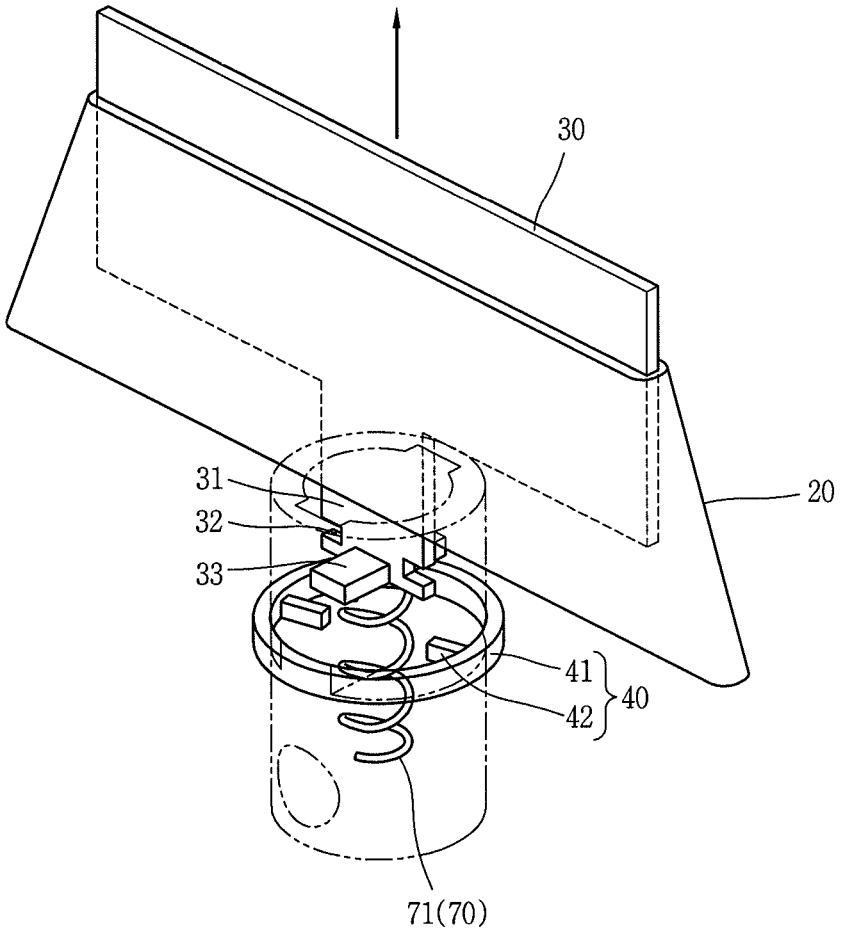

At the instant when the locking is cancelled, as illustrated in FIGS. 4B to 4D, the guide protrusion 42 on the shaft connection portion 31 moves along the guide groove 52 formed in the internal surface of the drive shaft 50 by the elastic restoring force that is exerted by the compression spring 71. Thus, the auxiliary wing 30 is spread outward from within the steering wing 20.

Figure 5:
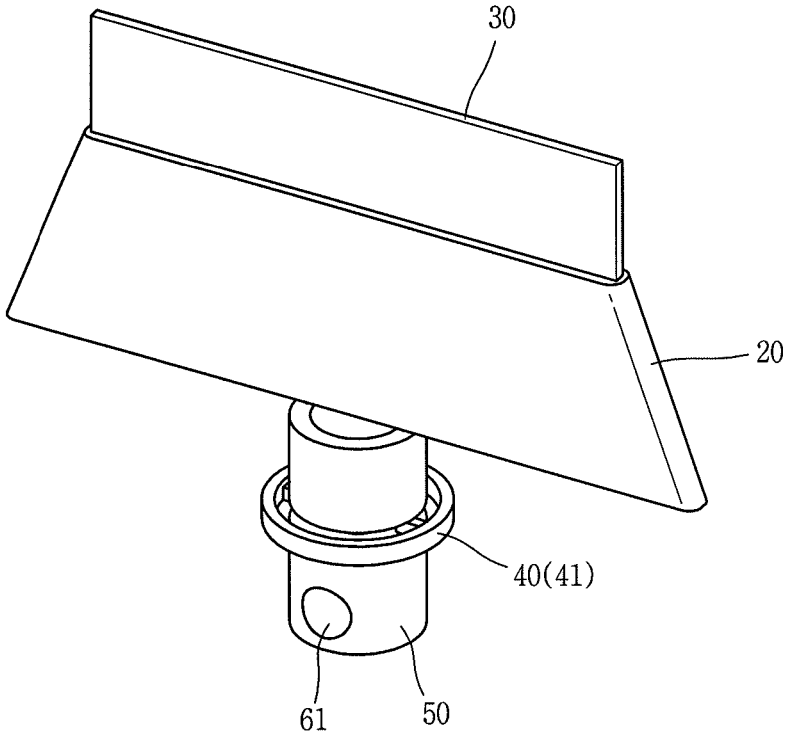
FIG. 5 is a perspective diagram illustrating that the auxiliary wing is spread outward from within the steering wing.

FIG. 5 is a perspective diagram illustrating that the auxiliary wing 30 is spread outward from within the steering wing 20.

Thus, in the trajectory flight section, the auxiliary wing 30 is held in place within the steering wing 20, thereby minimizing the aerodynamic drag. When the steering wing 20 is made to operate in the guided flight section, the drive shaft 50 rotates by the rotational force that, through the driving-unit connection shaft 61, is transferred from the driving unit 60 that drives the steering wing 20. Thus, the auxiliary-wing holding unit 40 performs the unlocking and the auxiliary wing 30 is spread outward from within the steering wing 20 by the compression spring 71 without using a separate driving device.

In addition, the point in time where the auxiliary wing 30 is projected (spread) can be adjusted to a point in time where the steering wing 20 is driven, and the auxiliary wing 30 is spread in the guided flight section, but not in the trajectory flight section. This provides an advantage of minimizing an increase in the aerodynamic drag that acts on the shell 10 and a decrease in the range, which are due to an increased area of the steering wing 20.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A shell comprising:

a shell body;

a steering wing that includes a drive shaft and that is rotatably mounted on an external surface of the shell body;

an auxiliary wing that includes a shaft connection portion which is connected to the drive shaft in such a manner that the auxiliary wing is able to move in the lengthwise direction of the drive shaft within the drive shaft, and that is installed in such a manner that the auxiliary wing is able to be inserted into and be spread outward from within the steering wing;

an auxiliary-wing holding unit that includes a holding protrusion which is fixedly arranged in a direction of intersecting the shaft connection portion in such a manner that the holding protrusion is engaged with or disengaged with the shaft connection portion depending on an angle at which the drive shaft rotates, and that selectively holds the auxiliary wing in place; and an auxiliary-wing spreading unit that is installed within the drive shaft, and that provides driving force for spreading the auxiliary wing outward from within the steering wing when the holding protrusion is disengaged with the shaft connection portion.

2. The shell of claim 1, wherein a locking groove is formed in a lateral surface of the shaft connection portion in such a manner that the holding protrusion is able to inserted into the locking groove, and wherein the holding protrusion is engaged with the locking groove, thereby holding the auxiliary wing in place within the steering wing after the auxiliary wing is inserted into the steering wing.

3. The shell of claim 1, wherein a guide groove is concavely formed in an internal surface of the drive shaft along the lengthwise direction of the drive shaft, and wherein a guide protrusion is formed on a lower end portion of the shaft connection portion in such a manner that the guide protrusion protrudes toward an internal surface of the drive shaft and moves along the guide groove.

4. The shell of claim 3, wherein the drive shaft includes a stopper that is formed on one end portion of the guide groove and prevents the guide protrusion from being separated from the guide groove.

5. The shell of claim 4, wherein a permanent magnet is built into each of the guide protrusion and the stopper, and wherein, when the guide protrusion is positioned adjacent to the stopper, the guide protrusion is held in place with respect to each other.

6. The shell of claim 3, wherein while the shell body is in trajectory flight, the auxiliary is inserted into the steering wing, and at a point in time where the shell body flies from a trajectory flight section to a guided flight section, the auxiliary wing is spread outward from within the steering wing by the auxiliary-wing spreading unit.

7. The shell of claim 3, wherein at least two or more holding protrusions are formed within the auxiliary-wing holding unit in such a manner that the two or more holding protrusion are positioned a distance away from one another.

8. The shell of claim 3, wherein the steering wing includes a driving-unit connection shaft is connected to one end portion of the drive shaft in such a manner that the auxiliary wing pierces through the one end portion of the drive shaft in the direction of the diameter, and wherein with driving force that is transferred from a driving unit installed within the shell body, the steering wing rotates.

9. The shell of claim 3, wherein the holding protrusion and the guide protrusion are arranged in such a manner that the holding protrusion and the guide protrusion intersect each other.

10. The shell of claim 1, wherein the auxiliary-wing spreading unit is installed between the shaft connection portion of the auxiliary wing and the drive shaft, and wherein the auxiliary-wing spreading unit is a compression spring that elastically supports the auxiliary wing.

11. The shell of claim 1, wherein a protrusion insertion hole is formed in an external surface of the drive shaft along circumference of the drive shaft in such a manner that the holding protrusion passes through the protrusion insertion hole for insertion.

12. The shell of claim 1, wherein the auxiliary-unit holding unit includes a holding portion that supports the holding protrusion and that is fixedly installed within the shell body in such a manner that the holding portion is positioned a distance away from an external surface of the drive shaft, and wherein the holding protrusion is formed on an internal surface of the holding portion in such a manner that the holding protrusion extends inward toward the center of the holding portion from the internal surface of the holding portion.

* * * * *